US005151670A

United States Patent [19]

Blair et al.

[11] Patent Number: 5,151,670

[45] Date of Patent: Sep. 29, 1992

[54] DUPLEXING FILTER

[75] Inventors: William D. Blair, Lanoka Harbor; Salvatore Bentivenga, Manalapan, both of N.J.

[73] Assignee: Radio Frequency Systems, Inc., Marlboro, N.J.

[21] Appl. No.: 686,325

[22] Filed: Apr. 10, 1991

[51] Int. Cl.[5] ..... H01P 1/205; H01P 5/12

[52] U.S. Cl. ..... 333/126; 333/124

[58] Field of Search ..... 333/126, 127, 134, 203; 370/24

[56] References Cited

U.S. PATENT DOCUMENTS

| | | | |
|---|---|---|---|
| 3,068,428 | 12/1962 | Alford et al. . | |
| 3,597,709 | 8/1971 | Rhodes . | |
| 3,733,608 | 5/1973 | McGhay et al. . | |
| 3,742,390 | 6/1973 | Stiglitz et al. | 333/134 |
| 3,818,389 | 6/1974 | Fisher . | |
| 4,091,344 | 5/1978 | La Tourrette . | |
| 4,121,181 | 10/1978 | Nishikawa et al. | 333/134 X |
| 4,168,479 | 9/1979 | Rubin . | |
| 4,210,881 | 7/1980 | Rubin . | |
| 4,281,302 | 7/1981 | Stegens . | |
| 4,450,421 | 5/1984 | Meguro et al. . | |
| 4,488,130 | 12/1984 | Young et al. . | |
| 4,596,969 | 6/1986 | Jachowski . | |
| 4,937,533 | 6/1990 | Livingston | 333/126 |
| 4,980,662 | 12/1990 | Simon et al. | 333/134 |

FOREIGN PATENT DOCUMENTS

| | | | |
|---|---|---|---|
| 3028925 | 2/1982 | Fed. Rep. of Germany . | |
| 103656 | 8/1979 | Japan . | |
| 43802 | 4/1981 | Japan | 333/134 |
| 11004 | 1/1984 | Japan . | |
| 122201 | 7/1984 | Japan | 333/134 |
| 720587 | 3/1980 | U.S.S.R. . | |
| 1191984 | 5/1970 | United Kingdom . | |

*Primary Examiner*—Paul Gensler

*Attorney, Agent, or Firm*—Ware, Fressola, Van Der Sluys & Adolphson

[57] ABSTRACT

A duplexing filter filters high frequency electromagnetic signals operating in two different frequency bands and uses a common coupling line mounted within an overall housing. Both filters use resonators and may be configured as combine or interdigital type filters. The high frequency filter has at least some of its resonators mounted on a base plate which in turn is positioned at a location along the length of the common coupling line so as to couple the higher frequency filter at its approximate quarter-wave location.

7 Claims, 4 Drawing Sheets

DUPLEXING FILTER

FIELD OF THE INVENTION

The present invention relates to high frequency resonant cavity filters and, more particularly, a duplexing filter which combines two resonant cavity filters in a common housing so as to enable their use via a common coupling port.

BACKGROUND OF THE INVENTION

The use of high frequency filters with associated resonant cavities is well-known in the art.

The invention described herein relates to a duplexing filter for combining filters operating at two different frequencies, such as at 400 MHz and 800 MHz. The concept of placing two high frequency filters in the same resonant housing is unique due to its use of a single feedline from the filter housing to an associated antenna or the like. The potential savings of labor and installation costs associated with a single feedline for both 400 MHz and 800 MHz frequency bands, as opposed to separate feedlines for each of these frequency bands, could be very large.

The present invention achieves this duplexing filter by positioning the high frequency filter approximately half way with respect to the shorted end of the lower frequency coupling line.

SUMMARY OF THE INVENTION

The present invention provides a means for combining two high frequency filters with separate operating frequencies in the same resonant cavity housing. Within this housing, the two filters share a common coupling line and output port.

In the preferred embodiment of the present invention, a resonant cavity housing is constructed to accommodate a 400 MHz filter comprising a plurality of resonators. An 800 MHz filter is constructed on a separate mounting plate inside this housing. Both of these filters are designed using standard combline or interdigital techniques.

The wavelength of the center frequency for the 800 MHz filter is approximately half the wavelength of the center frequency for the 400 MHz filter. The distance from the shorted end of the coupling line to the shorted end of the closest resonator of the 400 and 800 MHz filters is set so as to be approximately one quarter of a wavelength for each respective filter. The present invention achieves this result by use of a separate mounting plate for the 800 MHz filter with the resonant cavity housing.

Due to the fact that the common coupling line interfaces with a single coupling line, the impedance of the coupling line must match the filters to which it interfaces. The present duplexing filter thereby results in a compact design with minimal coupling components.

OBJECTS OF THE INVENTION

A principal object of the present invention is to provide a duplexing filter that uses a common coupling line for two filters within the same housing by positioning the coupling resonator of each filter at approximately one-quarter wavelength from the shorted end of the common coupling line.

Another object of the present invention is to provide a duplexing filter of the above description that mounts at least some of the higher frequency filter resonators on a base plate which is positioned within the housing so as to enable the quarter-wave coupling.

Other objects of the present invention will in part be obvious and will in part appear hereinafter.

BRIEF DESCRIPTION OF THE DRAWINGS

For a better understanding of the nature and objects of the present invention, reference should be made to the following detailed description taken in connection with the accompanying drawings, in which.

DETAILED DESCRIPTION OF THE INVENTION

Figure 1:
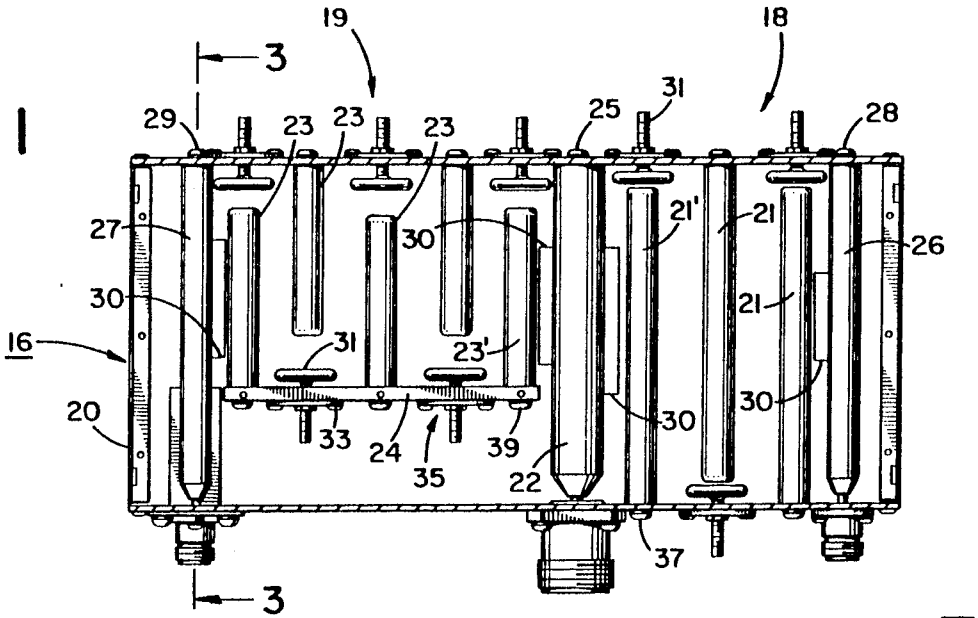
FIG. 1 is a top cross-sectional view taken along line 1—1 of FIG. 2, illustrating an interdigital type of duplexing filter according to the present invention.
Figure 4:
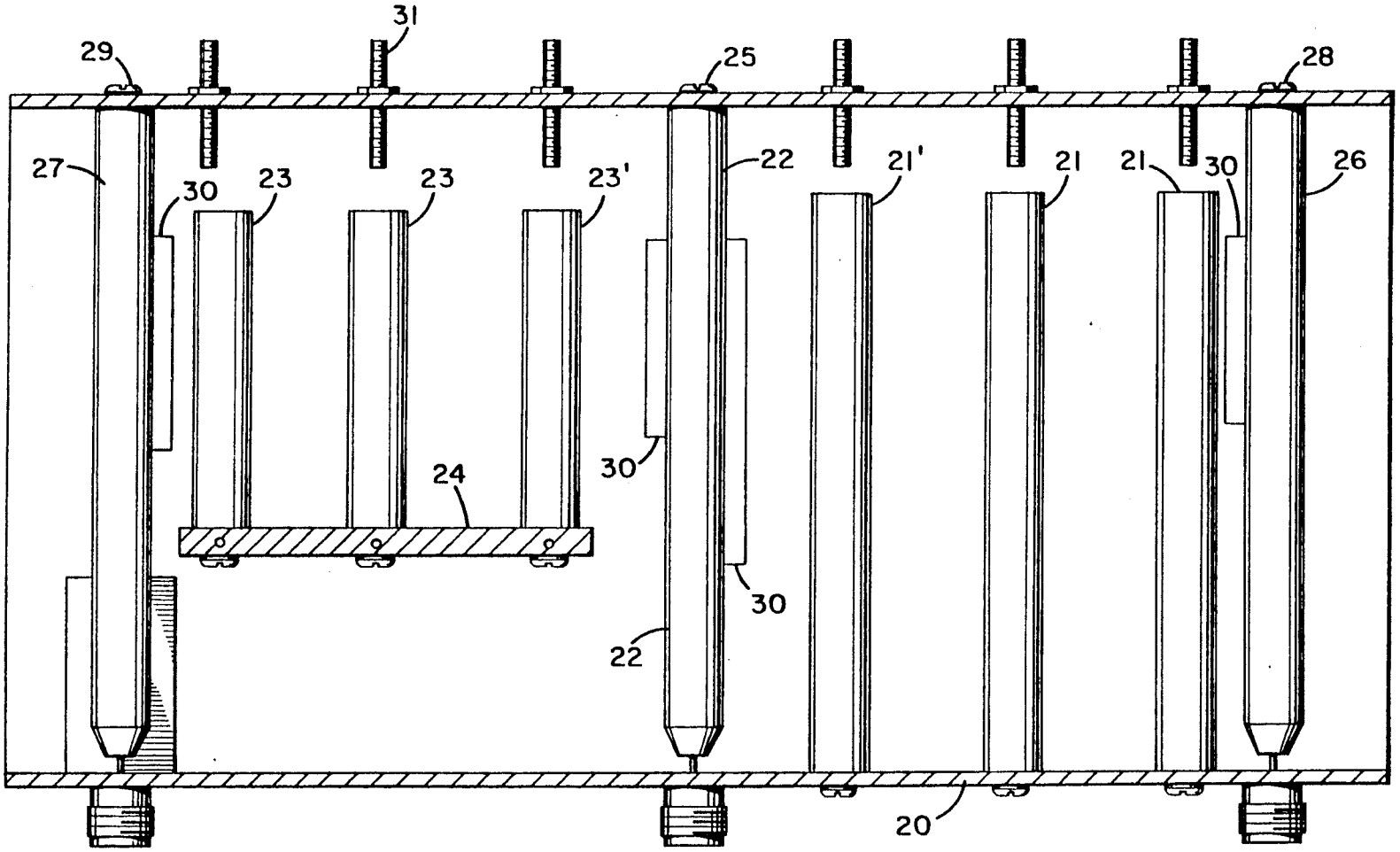
FIG. 4 is a cross-sectional view of a combine type of a duplexing filter according to the present invention.
Figure 5:
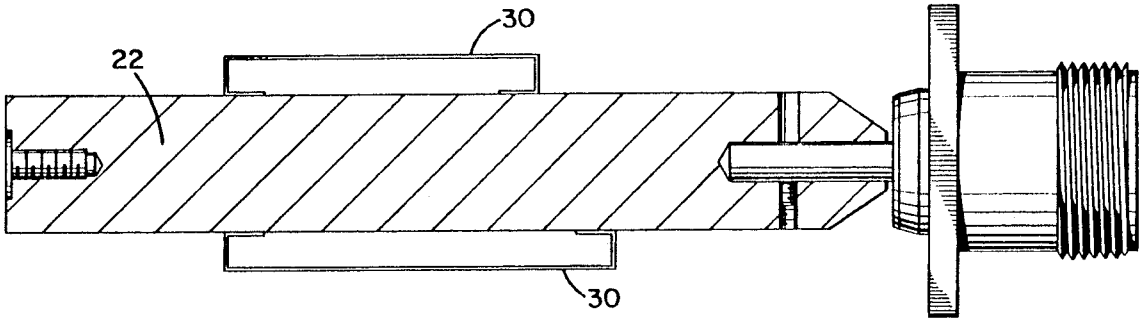
FIG. 5 is an enlarged partial cross-sectional view of the common coupling rod shown in FIG. 1.
Figure 6:
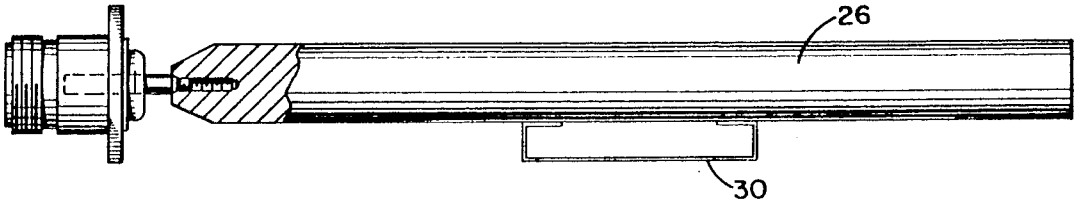
FIG. 6 is an enlarged partial cross-sectional view of the input coupling rod for the low frequency filter portion of the duplexing filter shown in FIG. 1.
Figure 7:
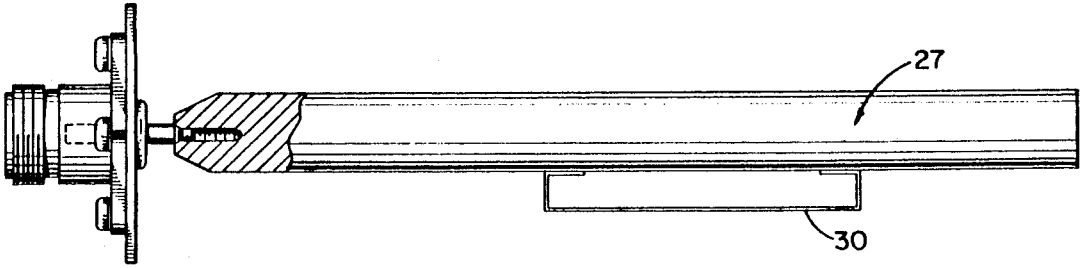
FIG. 7 is an enlarged partial cross-sectional view of the input coupling rod for the high frequency filter portion of the duplexing filter shown in FIG. 1.
Figure 11:
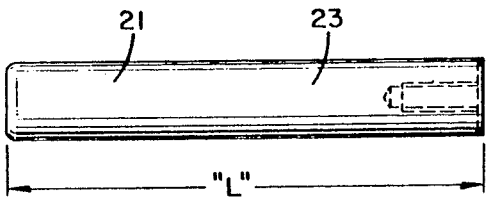
FIG. 11 is an enlarged view of one of the resonators used in the duplexing filter shown in FIG. 1.

As best seen in FIG. 1, an interdigital type of duplexing filter according to the present invention comprises a resonant cavity housing 20 which contains two high frequency filters 18 and 19. FIG. 4 illustrates a combline type of duplexing filter according to the present invention. Both types of duplexing filters are constructed in a similar manner and therefore share common referencing throughout this detailed description.

Figure 2:
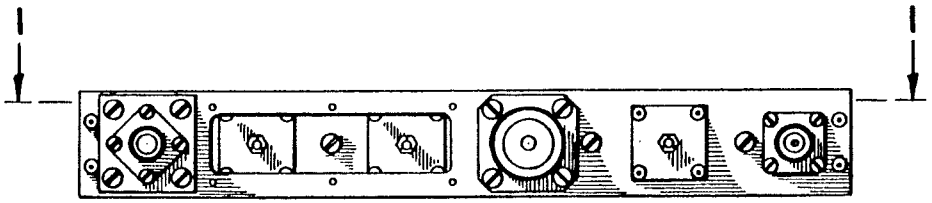
FIG. 2 is a front view of duplexing filter taken along line 2—2 of FIG. 1.
Figure 3:
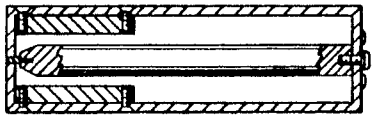
FIG. 3 is a cross-sectional view of the duplexing filter taken along line 3—3 of FIG. 1.

As seen in FIGS. 1 and 2, the resonant cavity housing 20 of the duplexing filter contains both low frequency (400 MHz) and high frequency (800 MHz) filters in a preferred embodiment of this invention. Of course, other frequencies could be used by appropriate design of the respective filters. The low frequency filter 18 is positioned on the right side of the duplexing filter housing as shown in FIGS. 1 and 2. The high frequency filter 19 is positioned on the left side of the duplexing filter housing. The housing is typically constructed of aluminum extrusion and is dimensioned so as to accommodate the larger low frequency resonators 21. The high frequency resonators 23 are attached to a separate base plate 24 within the housing. Details of these filter elements are shown in FIGS. 8–11. The resonator shown in FIG. 11 can be used for both the low and high frequency filters, by varying the length "L" of the respective resonators.

A common coupling line 22, shorted to the housing at point 25, is positioned approximately midway between the 400 MHz and 800 MHz filter assemblies. The coupling line typically has a shape and diameter similar to resonators 21 and 23. The proposed method of coupling the 400 MHz and 800 MHz frequency bands to this common coupling line utilizes the fact that the frequencies in the 800 MHz band have approximately half the wavelength of those in the 400 MHz band. Therefore, to achieve the same desired coupling effect from the shorted coupling line, the 800 MHz filter mounting plate 24 is positioned approximately halfway along the length of the shorted end 25 of the common coupling line 22. The shorted end 39 of resonator 23' is thus located approximately one quarter wavelength (of the high frequency filter center frequency) from the shorted end 25 of common coupling line 22. Resonator 21' of the low frequency filter similarly has its shorted end 37 located approximately one quarter wavelength (of the low frequency filter center frequency) from the shorted end 25 of coupling line 22.

The exact spacing of the common coupling line 22 to the closest resonator, 21' or 23', of each filter, may be analytically or empirically determined, and is set so as to achieve optimal impedance matching.

The low frequency input coupling line 26 and the high frequency input coupling line 27 are respectively shorted to the housing at points 28 and 29. As best seen in FIGS. 1, 5, 6 and 7, both the low frequency and the high frequency input coupling lines and the common coupling line 22 contain impedance matching wire loops 30 to insure a consistent impedance throughout the duplexing filter. The impedance of the coupling lines is critical in this application and thus to the proper operation of the duplexing filter. The coupling lines are consequently set to the same impedance as that into which the duplexing filter is attached.

Figure 14:
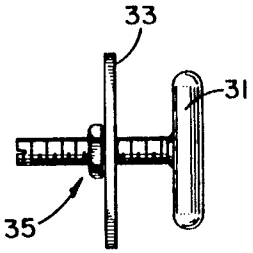
FIG. 14 is an enlarged assembly view of a tuning flange assembly.
Figure 13:
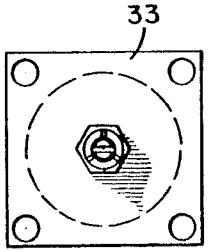
FIG. 13 is an enlarged view of one of the tuning flanges used in the duplexing filter shown in FIG. 1.
Figure 10:
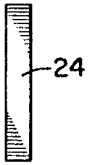
FIG. 10 is a side view of the base plate taken along line 10—10 of FIG. 8.
Figure 8:
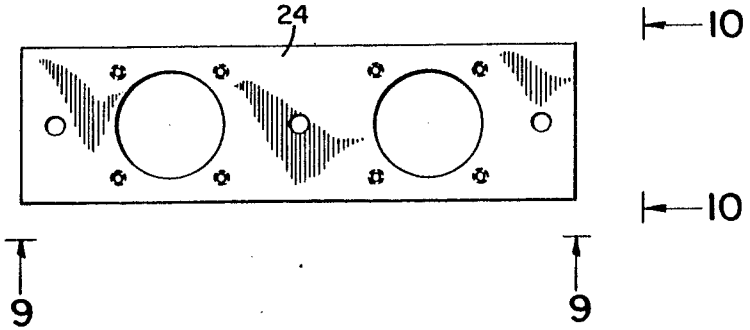
FIG. 8 is a top view of the base plate forming part of the high frequency filter portion of the duplexing filter shown in FIG. 1.
Figure 9:
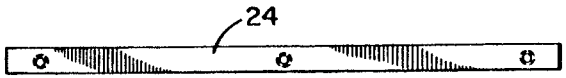
FIG. 9 is a front view of the base plate taken along line 9—9 of FIG. 8.
Figure 12:
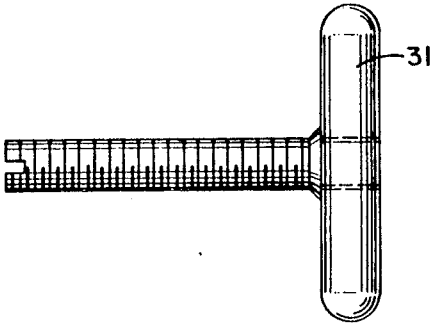
FIG. 12 is an enlarged view of one of the tuning discs used in the duplexing filter shown in FIG. 1.

Each resonator, 21 and 23, of either the low frequency or the high frequency filters is provided with tuning rod assemblies 31 for the purpose of fine tuning the filter characteristics. FIGS. 1 and 12 show these tuning rod assemblies while FIGS. 1, 13 and 14 illustrate the tuning flange 33 and the overall tuning flange assembly 35.

The overall result is a duplexing filter which can couple two high frequency filters to a single coupling line.

It is thus seen that the objects set forth above and those made apparent from the preceding description are efficiently attained and, since certain changes may be made in the above construction without departing from the scope of the invention, it is intended that all matter contained in the above description or shown in the accompanying drawings shall be interpreted as illustrative and not in a limiting sense.

Having described the invention, what is claimed is:

1. A duplexing filter comprising:

a) a housing;

b) a common coupling line electrically connected to the housing at one end of the coupling line;

c) a plurality of first resonators operating about a first predetermined frequency mounted within the housing and coupled to said common coupling line via one of said first resonators;

d) a plate mounted within the housing and electrically connected thereto;

e) a plurality of second resonators operating about a second predetermined higher frequency than the first predetermined frequency, said second resonators each having a first end mounted to the plate so that the plate forms a base upon which the resonators are mounted, wherein said plate is positioned within the housing so that one of the second resonators is electrically connected to the plate at said first end at a position from the one end of the common coupling line approximately one-quarter the wavelength of the second predetermined frequency so as to facilitate coupling of the second resonators to the common coupling line;

f) means for coupling electromagnetic energy to the plurality of first resonators; and g) means for coupling electromagnetic energy to the plurality of second resonators.

2. A duplexing filter as defined in claim 1, wherein the plurality of first resonators and the plurality of second resonators are positioned within the housing to form respective interdigital filters.

3. A duplexing filter as defined in claim 1, wherein the plurality of first resonators and the plurality of second resonators are positioned within the housing to form respective combline filters.

4. A duplexing filter as defined in claim 1, wherein the common coupling line further comprises a first wire loop positioned in proximity to the one first resonator for facilitating coupling the first resonators to the common coupling line and a second wire loop positioned in proximity to the one second resonator for facilitating coupling the second resonators to the common coupling line.

5. A duplexing filter as defined in claim 4, wherein the coupling means for the plurality of first resonators and the coupling means for the plurality of second resonators each comprise a coupling line mounted within the housing and positioned in proximity to the respective resonator furthest from the one resonator of the plurality of first and second resonators.

6. A duplexing filter as defined in claim 5, wherein the respective coupling line associated with the plurality of first and second resonators further comprises a wire loop for facilitating coupling between the coupling line and said furthest resonator from the respective one resonator.

7. A duplexing filter as defined in claim 6, wherein the first predetermined frequency is approximately 400 MHz and the second predetermined frequency is approximately 800 MHz.

* * * * *

UNITED STATES PATENT AND TRADEMARK OFFICE

CERTIFICATE OF CORRECTION

PATENT NO. : 5,151,670

DATED : September 29, 1992

INVENTOR(S) : William D. Blair and Salvatore Bentivenga

It is certified that error appears in the above-identified patent and that said Letters Patent is hereby corrected as shown below:

On the title page:Item [57]:
In the Abstract, line 5 , "combine" should be --combline--.

Signed and Sealed this

Twelfth Day of October, 1993

*Attest:*

*Attesting Officer*

BRUCE LEHMAN

*Commissioner of Patents and Trademarks*